United States Patent [19]

Burnett

[11] 3,963,288

[45] June 15, 1976

[54] TRANSPORTABLE OVERBED TABLE

[76] Inventor: John W. Burnett, 1226 Edmer Ave., Oak Park, Ill. 60302

[22] Filed: June 9, 1975

[21] Appl. No.: 585,349

Related U.S. Application Data

[62] Division of Ser. No. 428,359, Dec. 26, 1973, Pat. No. 3,908,565.

[52] U.S. Cl. ..... 312/209; 108/139; 312/202

[51] Int. Cl.[2] ..... A47F 5/08

[58] Field of Search ..... 108/32, 103, 94, 139, 108/147, 150; 312/202, 209, 223, 246, 250; 5/317

[56] References Cited

UNITED STATES PATENTS

| | | | |
|---|---|---|---|
| 3,094,949 | 6/1963 | Oom | 108/139 |
| 3,280,458 | 10/1966 | Deeley, Jr. et al. | 312/209 |
| 3,304,609 | 2/1967 | Horowitz | 312/209 |
| 3,366,430 | 1/1968 | Diedrich | 312/209 |

*Primary Examiner*—Casmir A. Nunberg

[57] ABSTRACT

A transportable overbed table embodying a wheeled base from which there projects upwardly a vertical column on which there is vertically slidable a table-supporting carriage. An elevation screw is provided for raising and lowering the carriage. In one form of the invention such carriage movement is effected under the control of an electric motor and in another form it is effected manually under the control of a hand wheel. In the latter instance, the weight of the table is counterbalanced by means of an involute clock-type spring which is associated with the elevation screw. In both forms, the carriage preferably, but not necessarily, may support one or more drawer units which are capable of universal swinging movement in a horizontal plane.

6 Claims, 6 Drawing Figures

TRANSPORTABLE OVERBED TABLE

This is a division of application Ser. No. 428,359, now U.S. Pat. No. 3,908,565, filed Dec. 26, 1973.

The improved overbed table construction comprising the present invention has been designed primarily for hospital use as an article of furniture which may be wheeled from a remote location and placed in a bedside position where the patient or attendant may manipulate the same in various ways to effect articulated movement of the components between overbed and out-of-the-way positions. The invention is, however, not limited to such hospital use and overbed tables embodying the principles of the present invention may, if desired, be employed as a household article of furniture, whether the same be associated with a bed or otherwise. Irrespective, however, of the particular use to which the invention may be put, the essential features thereof are at all times preserved.

Present day overbed tables designed for hospital use consist essentially of a wheeled rack having a lower base portion which is adapted to be projected beneath a bed frame, a vertical standard, and a horizontal table portion which overlies the base portion so that when the latter is projected beneath a bed frame, the table portion overlies the latter. Since many hospital beds are subject to height variation to accommodate the requirements of different patients, and also are articulated so that the patient may assume various reclining or upright positions, the vertical standards which are associated with such overbed tables are made adjustable in length. However, the lengthening and shortening of these standards is usually beyond the skill or ability of the patient and requires that the attendant shall loosen one or more set screws, make the desired adjustment, and finally retighten the set screw or set screws. Moreover, in the interests of safety, it usually is desirable before making a major adjustment to clear the table of its contents, particularly if filled liquid containers are involved. Once a particular overbed installation has been effected, any change in elevation usually requires that the table as a whole be withdrawn from the vicinity of the bed, adjusted and then returned to its overbed position.

Another limitation that is attendant upon the construction and use of conventional overbed tables resides in the fact that any storage space which may be provided for small personal articles assumes the form of a built-in drawer or under-shelf which is fixedly secured to the table proper and for which clearance must be provided when the table is in an overbed position, thereby raising the table to an undesirable height under some circumstances. Still further, since the table proper and the base are at all times vertically aligned, when the table is placed alongside the bed frame and used as a bedside shelf, the base portion must be withdrawn from beneath the bed frame and positioned where it consumes appreciable floor space in the vicinity of the bed.

The present invention is designed to overcome the above-noted limitations that are attendant upon the construction and use of present-day overbed tables and, toward this end, it contemplates the provision of an overbed table construction which embodies an upper table unit and, if desired, a drawer unit, or a set of drawer units, beneath the table unit, the various units projecting radially from a common supporting column which extends upwardly from a tractionally supported base which also projects radially from the column. The various units are hingedly connected at their proximate ends to the column for individual swinging movement in their respective horizontal planes, each independently of the others. In one form of the invention, power means are provided under the control of the patient for raising and lowering the elevation of the various units bodily in unison and regardless of the individual radial positions of such units. In a modified form of the invention, the power means is replaced by manually operable means which is actuated by means of a hand wheel. In both forms of the invention an elevation screw and nut arrangement effects the height adjustment and in the modified form, i.e., the manually operable form, a constant torque involute clock-type spring is provided for counterbalancing the weight of the drawers, table and their contents so that little effort on the part of the patient is required to effect a given height adjustment during raising of the drawer and table units, and also that there will be no free gravitationally induced run-out of the elevation screw relative to the nut.

The provision of an overbed table and drawer construction such as has briefly been outlined above constitutes the principal object of the present invention. Numerous other objects and advantages of the invention, not at this time enumerated, will become readily apparent as the nature of the invention is better understood.

In the accompanying two sheets of drawings forming a part of this specification, two illustrative embodiments of the invention have been shown.

Figure 1:
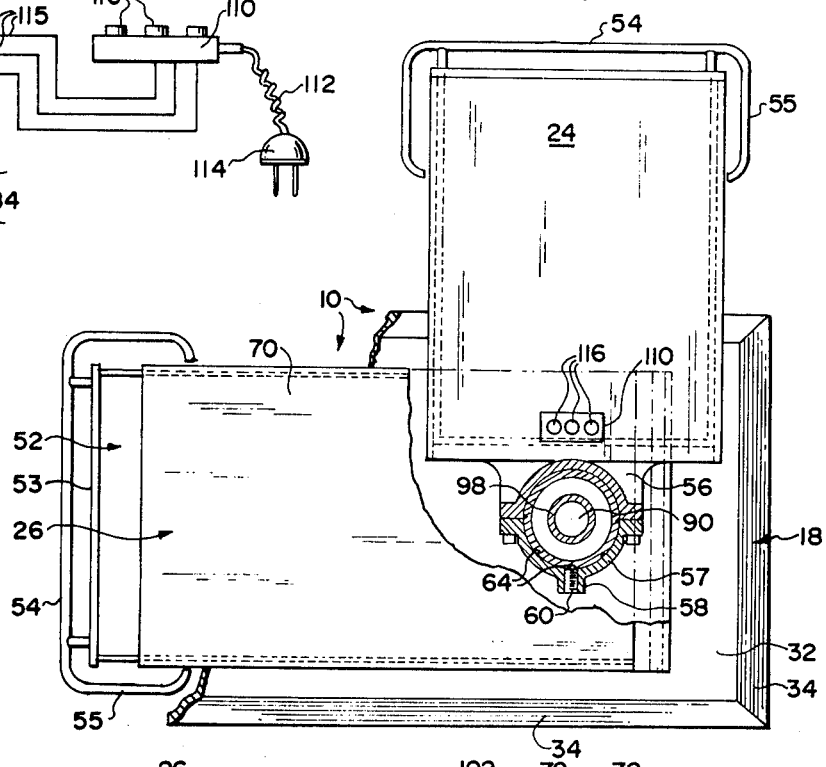
FIG. 1 is a top plan view of a transportable, electrically operable, combined overbed table embodying the principles of the present invention with portions thereof broken away and other portions being shown in section.
Figure 2:
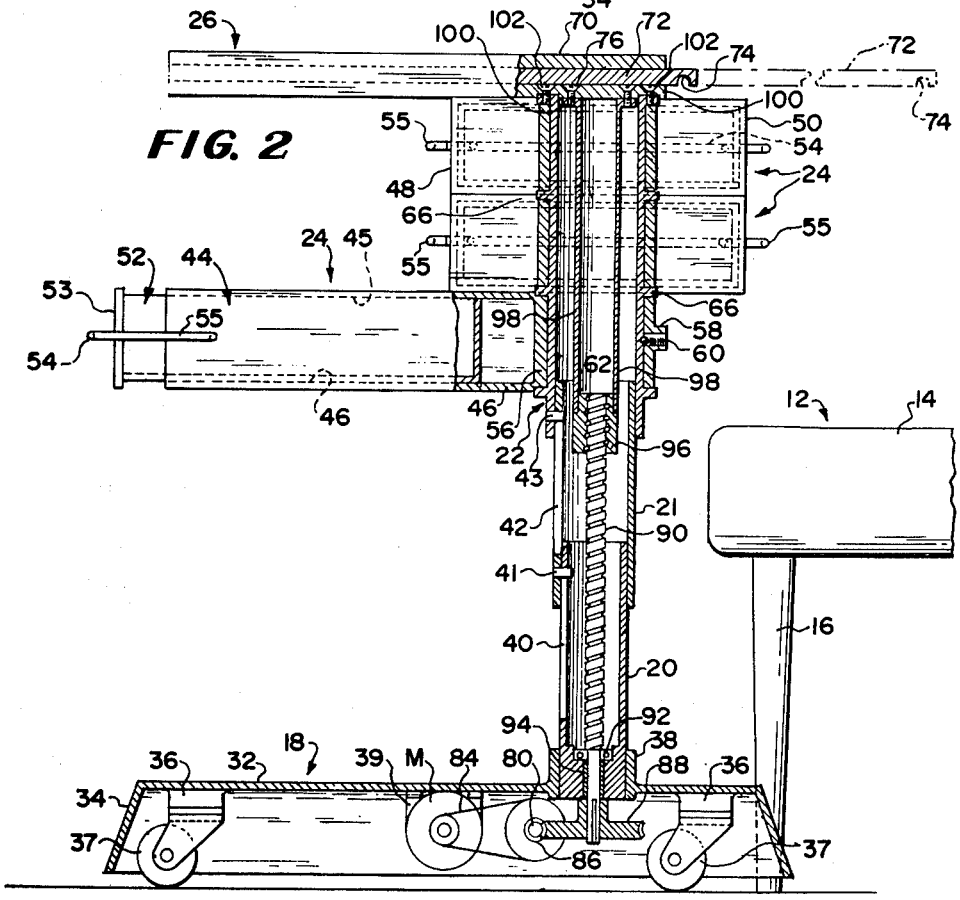
FIG. 2 is a sectional view, partly in elevation, taken centrally and vertically through the overbed table and showing the same in an operative bedside position.

Referring now to the drawings in detail and in particular to FIGS. 1 and 2, an overbed table and cabinet construction which is designated in its entirety by the reference numeral 10 is shown in operative association with a conventional hospital bed 12, the latter being schematically illustrated and including the usual bed frame 14 and supporting legs 16. Briefly, the combined table and cabinet 10 (which will hereinafter be referred to simply as the cabinet) involves in its general organization a tractionally supported base 18 from which there projects vertically upwardly a tubular column 20 which telescopically and slidingly receives thereover an intermediate tubular column extension 21 which, in turn, receives thereover a shiftable, sleeve-like tubular table- and drawer-supporting carriage 22 on which there are mounted a plurality of drawer units 24, together with a table unit 26.

The drawer units 24, as well as the table unit 26, project radially outwardly from the tubular sleeve-like carriage 22. The table unit 26 has its proximate end fixedly secured to the upper end of the tubular carriage 22 which the drawer units 24 have their proximate ends rotatably mounted on the carriage 22 so that they are capable of individual swinging movement throughout an angle of 360° in either direction about the vertical axis of such carriage. As will be described in greater detail presently, the tubular carriage 22 is capable of vertical shifting movement under the control of a reversible electric motor M in order to bring one or more of the drawer units 24 to elevations wherein they will clear the bed frame 14 so that they may be individually or collectively swung thereover as shown in FIG. 2 when the base 18 is projected beneath such bed frame. The table unit 26 assumes an elevation above that of the bed frame 14 regardless of the elevational position of the tubular carriage 22 so that in any adjusted position of the carriage, the table unit may be caused to overlie the bed.

Although the drawer units 24 are capable of being swung selectively through an angle of 360° into and out of position from beneath the table unit 26, in the ordinary usage of the cabinet 10 these units are normally maintained in a vertically stacked relationship, so to speak, wherein they are in superimposed relationship and wherein they overlie the major projecting portion of the base 18, such disposition of the units being a convenient one for minimum space consumption when the cabinet 10 is remote from the bed, as for example across the room and against a wall. When brought to a bedside position, a minor projecting portion of the base may be positioned beneath the bed frame 14 as shown in FIG. 2, after which the drawer units 24 and table unit 26 may be variously disposed so as to extend outwardly from the bed where they are accessible to a nurse or other attendant, or alongside the bed frame at a selected elevation where they are accessible to the patient. Alternatively, a major portion of the base may be projected beneath the bed frame by reversing the position thereof, in which case the base will assume an out-of-the-way position.

Considering the cabinet 10 in greater detail, and referring specifically to FIG. 2, the base 18 is preferably in the form of a relatively heavy shell-like casting of generally rectangular design and having a flat top wall 32 and an outwardly slanting continuous apron portion 34. Articulated caster frames 36 which are secured to the underneath side of the top wall 32 carry rollers 37, it being understood that four such caster frames and their associated rollers are disposed adjacent to the four corners of the base. An integral sleeve-like boss 38 is formed on the top wall 32 and fixedly receives therein the lower end of the aforementioned tubular column 20. Preferably the boss 40 is disposed adjacent to the rear of the rectangular base for overall stability purposes. The aforementioned electric motor M is suitably suspended by means of a motor mount 39 from the underneath side of the top wall 32.

The fixed tubular column 20 is formed with a longitudinal slot 40 therein which receives a pin 41 that is mounted on the lower end of the intermediate column extension 21, while the extension itself is formed with a slot 42 that similarly receives a pin 43 on the lower end of the tubular drawer and table supporting carriage 22.

The column 20, extension 21 and carriage 22 thus assume an extensible and contractible telescopic relationship.

The various drawer units 24 are of identical construction and therefore a description of one of them will suffice for them all. Each drawer unit 24 consists of a box-like drawer casing 44 of elongated and generally rectangular design, the casing presenting top and bottom walls 45 and 46, side walls 48 and 50 and an inner or rear end wall 52. The outer or front end of the drawer casing 42 is open for reception within the casing of a drawer proper 52.

Except for the provision of a novel manipulating handle construction, the drawer proper 52 is of conventional box-like or bin-like design and is provided with a front drawer panel or wall 53 to which the handle construction is secured. The handle construction is in the form of a length of rod stock having a horizontal section 54 which terminates in laterally turned end sections 55 that straddle the sides of the drawer and which also overhang and straddle the sides of the drawer casing 42 when the drawer is in its fully retracted position.

As best shown in FIG. 1, the inner or rear wall 52 of the drawer casing is provided with a bearing block or pillar block 56 which cooperates with a bearing cap 57 in retaining the inner end of the drawer unit 24 in position on the tubular carriage 22 while at the same time allowing the drawer unit to swing in either direction. The bearing cap 57 is provided with a centrally disposed boss 58 (see also FIG. 2) which threadedly receives therein a conventional detent plug 60 having a spring-pressed detent ball 62 associated therewith, the ball cooperating with a series of detent recesses 64 which are circumferentially spaced around the tubular sleeve-like carriage 22 and serve to yieldingly maintain the drawer unit 24 in selected radial positions in a manner and for a purpose that will be made clear subsequently.

In order to support the various drawer units 24 at their proper elevations on the carriage 22, the latter has formed thereon a plurality of continuous annular seating ribs or races 66, there being one such rib for each drawer casing 42. The lower arcuate edges of the bearing block 54 and its cap 56 slidingly rest upon a respective rib 66, thus establishing the desired longitudinal position of the drawer casing on the carriage 22. Adjacent ribs 66 confine the two lowermost drawer casings therebetween, while the uppermost drawer casing is confined between one of the ribs 66 and the table unit 26. Reference to FIG. 2 will reveal the fact that the lower inner edges of the drawer casings 42 are recessed to receive the associated annular ribs 66 so that adjacent drawer units assume contiguous positions relative to one another when the series of units 24 are in their superimposed relationship.

The table unit 26 is disposed immediately above the uppermost drawer unit 24 and it is comprised of a hollow table proper 70 and an inner extensible table leaf 72. The table 70 is of flat open-ended hollow construction and the table leaf 72, which is slidably disposed within the table 70, is movable between the inner retracted position in which it is shown in full lines in FIG. 2 and the dotted line projected position wherein it overlies the bed frame 14. The table leaf 72 is slightly longer than the table 70 so that the forward or outer end of the former overhangs the outer edge of the latter. A finger grip or recess 74 is provided on the underneath side of the overhanging portion of the table leaf to facilitate manipulation of the latter. The inner end of the table 70 is fixedly secured by anchoring screws 76 or the like to the upper edge or rim of the tubular carriage 22.

Referring now to FIG. 2, power means are provided whereby the elevation of the drawer- and table-supporting carriage 22 may be varied at will, such means embodying the aforementioned electric motor M. Accordingly, the motor M is drivingly connected to a worm shaft 80 by a belt and pulley arrangement 84, the worm shaft being journalled at its ends in the opposite side walls of the apron portion 34 of the base 18. A worm 86 carried by the worm shaft 80 meshes with a toothed worm wheel 88 which is carried at the lower end of an elongated vertically extending screw shaft 90 which projects centrally and upwardly through the column 20 and is substantially coextensive therewith. The lower end region of the elevation screw 90 is rotatably journalled in the lower end of the column 20 by means of a ball bearing unit 92 and also by means of a bushing 94 which lends rigidity to the elevation screw 90 and maintains the same coaxial with the column.

In the operation of the above-described power means, when the reversible electric motor M is energized in such a manner as to rotate the worm shaft 80 in one direction, the worm wheel 88 and screw shaft 90 will be rotated in such a direction that the nut 96 will travel upwardly on the elevation screw 90, thus placing the guide sleeve 98 under compression and exerting a lifting action on the table unit 26. Inasmuch as the tubular carriage 22 is fixedly secured to the table unit 26 as previously described, upward movement of the table unit will serve to raise the carriage 22, together with the swingable drawer units 24 which are supported thereby. Conversely, when the motor 30 is energized so as to reverse the direction of rotation of the worm shaft 80, the nut 96 will travel downwardly on the elevation screw 90 and cause lowering of the guide sleeve 98, tubular carriage 22, drawer units 24 and table unit 26 bodily as a unit.

Figure 3:
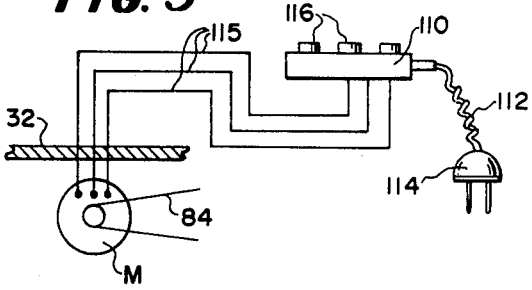
FIG. 3 is a circuit diagram illustrating schematically the control mechanism for raising and lowering the drawer units and the table unit which are associated with the cabinet.

In order that the patient, nurse, orderly or other attendant may selectively control the raising and lowering movements of the drawer- and table-supporting carriage 22, a push button control box or switch 110 may be suitably mounted in an appropriate position on the overbed table 10, as for example on the upper face of the table unit 70 near the proximate or inner end thereof. The switch 110 (see also FIG. 3) may be electrically connected by a pair of leads or wires 112 to an electrical plug-in device 114 whereby electric current from a commercial power line is made available. A series of three push buttons 116 including an "up" button, a "down" button and a "stop" button may be associated with the control switch 110 as is customary in connection with a wide variety of such push button control devices, these buttons variously controlling the flow of current to the motor M through suitable electric leads 118.

In the use of the herein described portable overbed table 10, the same will ordinarily be maintained in a closed or stored condition with the carriage 22 being in its lowermost position wherein all of the drawer units 24 and the table unit 26 extend radially over the projecting portion of the base 18 and with all of the drawers 52 and the table leaf 72 being retracted. The cabinet may then be wheeled in this condition to a bedside location by transporting the same on the caster rollers 38 to the vicinity of the hospital bed 12 and thereafter it may be positioned in various ways according to the dictates of the patient. Only one such position is illustrated in the drawings wherein the projecting portion of the base 18 extends outwardly away from the bed frame.

If the patient desires to use the table for writing purposes he may manipulate the control switch 110 in the manner previously described to elevate the carriage 22 and bring the table unit 26 to a height where it will clear his lap. Thereafter, he may pull the table unit toward him, thus rotating the entire overbed assembly and causing the projecting portion of the base 18 to extend beneath the bed frame. The drawer units 24, however, may be cause to lie alongside the bed frame.

Various other positions of the overbed table 10 may be attained by either the patient or an attendant. For example, if the patient does not require the use of the table unit he may push it aside so that it lies alongside the bed frame. Such movement of the table unit will, of course, cause the projecting portion of the base to lie alongside the bed. However, this does not preclude the patient from having access to the various drawer units, such access being obtainable by the simple expedient of pulling out the desired drawers from their casings.

Figure 6:
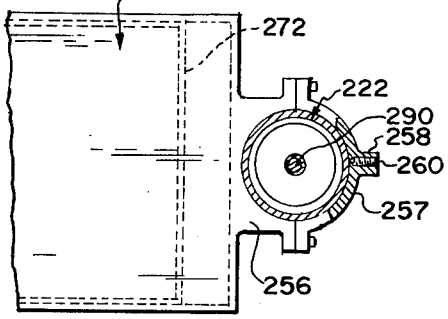
FIG. 6 is a sectional view taken substantially on the line 6—6 of FIG. 5.
Figure 4:
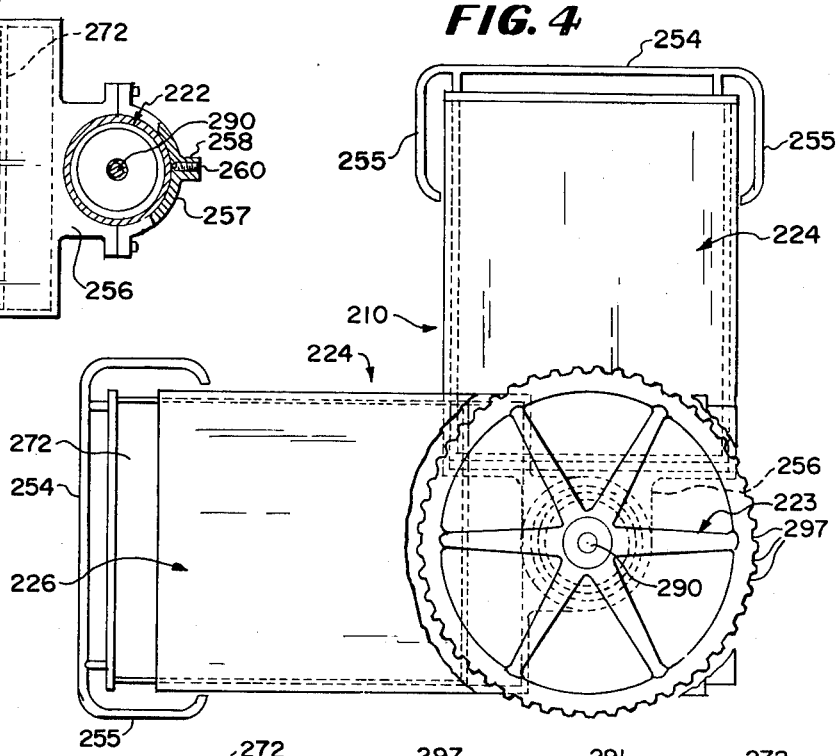
FIG. 4 is a top plan view, similar to FIG. 1, showing a modified manually operable form of the overbed table, the base being omitted in the interests of clarity.
Figure 5:
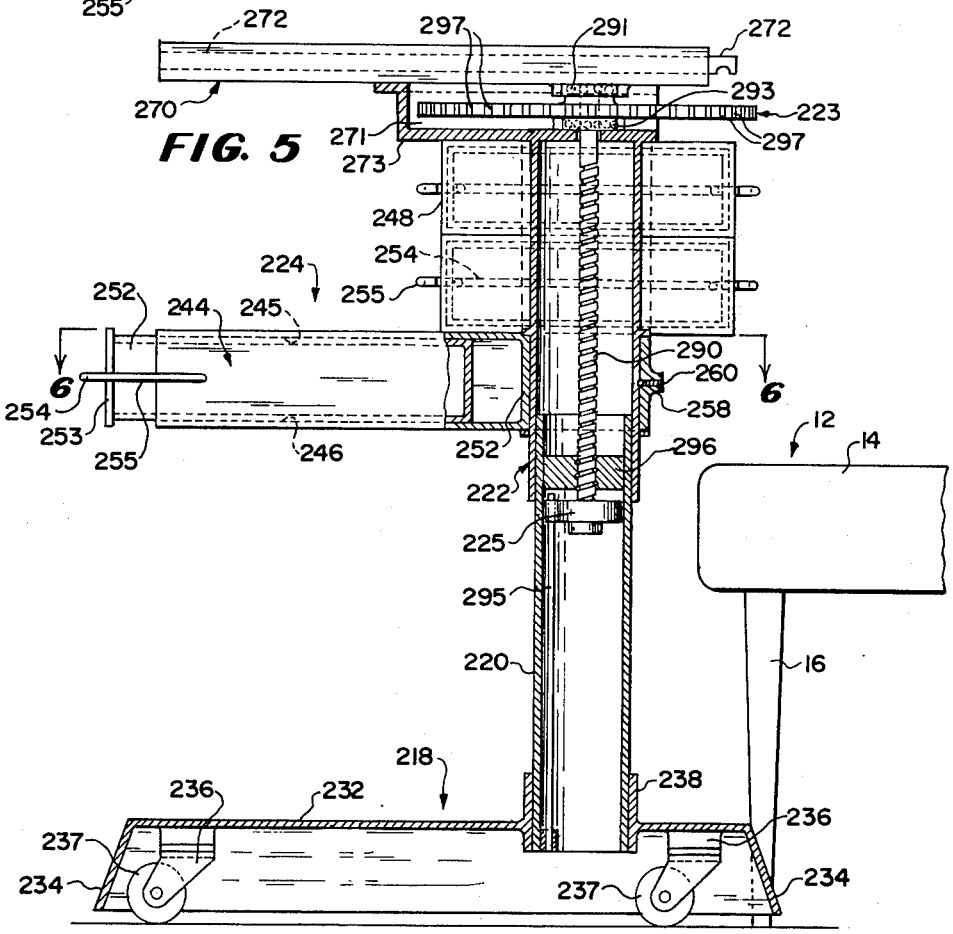
FIG. 5 is a sectional view, partly in section, taken substantially centrally and vertically through the structure of FIG. 4 with the base being restored.

In FIGS. 4, 5 and 6, a modified form of overbed table 210 is disclosed wherein the power actuated means for raising and lowering the tubular drawer and table supporting carriage 222 is replaced by a manually operable hand wheel 223 on the upper end of the elevation screw 290, and wherein the weight of the carriage and its associated drawer and table units 224 and 226 is counterbalanced by means of a constant tension involute clock-type spring arrangement 225. In this latter form of the table, the drawer units 224 and table unit 226 remain substantially the same as the previously described drawer and table units 24 and 26, while the base 218, as well as certain other component parts of the table, remain substantially the same as the corresponding parts which are associated with the table 22. Therefore, in order to avoid needless repetition of description, similar reference numerals but of a higher order have been applied to the corresponding parts as between the disclosures of FIGS. 4 and 5, and the disclosures of FIGS. 1 and 2 respectively.

The hand wheel 223 is disposed between the table 270 and the uppermost drawer unit 224 and it is nested within a recess 271 which is established beneath the table unit 270 by means of a table-supporting frame-like arrangement 273 on the upper end of the carriage 222.

In the cabinet 210, the supporting structure for the table- and drawer-supporting carriage 222 is similar to the supporting structure except for the fact that the intermediate tubular column extension 21 is omitted and the tubular carriage 222 is telescopically received directly on the fixed upstanding column 220. The elevation screw 290 is rotatably journalled at its upper end in upper and lower bearings 291 and 293 and the extreme lower end region of such screw is fixedly secured to the inner end of the aforementioned counterbalancing negator spring arrangement 225. The outer end of the negator spring arrangement is slidable vertically on a rod 295, the latter functioning as a reaction member to assimilate the torque which is applied thereto by the spring arrangement. The elevation screw 290 passes through a nut 296 which is fixedly secured within the column 220 and thus, as the elevation screw is turned in one direction or the other, the latter is caused to thread its way either upwardly or downwardly as the case may be. The upper and lower bearings 291 and 293 are in the form of thrust bearing which straddle the hand wheel 223 and which have their inner races secured to the elevation screw 290 and their outer races secured to the table unit 270 and frame 273. Thus, rotation of the elevation screw in a direction which causes the latter to move axially upwardly will exert a thrust through the lower bearing 293 which will carry the table 270, and consequently the entire carriage 222 and the drawer units carried thereby, upwardly. The hand wheel is fixedly secured on the extreme upper end of the elevation screw 290 and it is provided with peripheral depressions 297 which facilitate the application of torque to the wheel.

It will be understood that the table 220 is capable of assuming bedside positions similar to those described in connection with the table 10 and also is capable of the same articulated movements as those previously set forth. However, the patient or attendant, in manipulating the various actuating components in order to bring them to the desired positions, will rotate the hand wheel in an appropriate direction and the spring arrangement 225 will counterbalance the weight of the carriage 222 and its associated load so that very little effort on the part of the operator is required. Moreover, the counterbalancing spring arrangement 225 serves to prevent self-threading of the elevation screw 290 through the nut 296 due to the weight of the load.

The invention is not to be limited to the exact arrangement of parts shown in the accompanying drawings or described in this specification as various changes in the details of construction may be resorted to without departing from the spirit of the invention. For example, although the overbed table 10 has been shown and described herein as embodying a series of drawer units 24, it is contemplated that the overbed table may be constructed without providing drawer units, in which the structure involved will be devoid of cabinet facilities. Therefore, only insofar as the invention has particularly been pointed out in the accompanying claims is the same to be limited.

What is claimed is:

1. A transportable overbed table and cabinet construction comprising a wheeled base, a tubular column secured to and projecting upwardly from said base, said base presenting a portion which projects forwardly and radially from the column and is designed for disposition in the vicinity of a bed frame, a tubular carriage disposed in coaxial telescopic relationship with respect to said column, a table unit having its proximate end mounted on said carriage and projecting radially outwardly therefrom and overlying the projecting portion of the base, a drawer unit having its proximate end hingedly connected to the carriage beneath the table unit for swinging movement in a horizontal plane throughout an angle of at least 90°, a rotatable elevation screw and cooperating traveling nut disposed within the confines of the tubular carriage and column, effective between the carriage and column, and operable upon rotation of the elevation screw in opposite directions to raise and lower the carriage, and means for rotating said elevation screw.

2. A transportable overbed table and cabinet construction as set forth in claim 1, wherein said means for rotating the elevation screw comprises a reversible electric motor mounted on said base, means operatively connecting said motor to the elevation screw in driving relationship, and means establishing an electric circuit for the motor and including a directional control switch disposed for convenient access.

3. A transportable overbed table and cabinet construction as set forth in claim 2, wherein said base embodies a flat base plate having a peripheral depending apron portion, the motor is disposed beneath the base plate, a power train extends between the motor and elevation screw and includes a worm in meshing engagement with the worm wheel, and a belt and pulley arrangement operatively connecting the motor and worm.

4. A transportable overbed table and cabinet construction as set forth in claim 1, wherein said tubular column is of a sectional nature and embodies a lower section secured to the base and an upper section telescopically slidable on the lower section, a pin-and-slot connection is effective between the sections to prevent relative rotation therebetween, the tubular carriage is telescopically slidable on said upper section, and a second pin-and-slot connection is effective between the upper section and carriage to prevent relative rotation therebetween.

5. A transportable overbed table and cabinet construction as set forth in claim 4, wherein a plurality of drawer units have their proximate ends hingedly connected to the carriage beneath the table unit for independent swinging movement in respective horizontal planes throughout an angle of at least 90°, each drawer unit including a pull-out drawer proper, and said table unit includes a pull-out table leaf adapted, when projected from the table unit, to overlie the bed frame.

6. A transportable overbed table and cabinet construction as set forth in claim 5, wherein said table unit embodies a sheath-like horizontal table casing, and the pull-out table leaf is slidable within said sheath-like casing between a retracted position wherein it is substantially fully encased within the casing and projected positions at opposite ends of the casing.

* * * * *